United States Patent [19]

Yamakawa

[11] Patent Number: 4,480,612

[45] Date of Patent: Nov. 6, 1984

[54] INTERNAL COMBUSTION ENGINE PROVIDED WITH A PLURALITY OF POWER UNITS

[75] Inventor: Toru Yamakawa, Hachioji, Japan

[73] Assignee: Fuji Jukogyo Kabushiki Kaisha, Tokyo, Japan

[21] Appl. No.: 403,739

[22] PCT Filed: Nov. 30, 1981

[86] PCT No.: PCT/JP81/00361

§ 371 Date: Jul. 29, 1982

§ 102(e) Date: Jul. 29, 1982

[87] PCT Pub. No.: WO82/01915

PCT Pub. Date: Jun. 10, 1982

[30] Foreign Application Priority Data

Nov. 29, 1980 [JP] Japan ..... 55-168781

[51] Int. Cl.[3] ..... F02D 25/04

[52] U.S. Cl. ..... 123/198 F; 60/718; 123/DIG. 8

[58] Field of Search ..... 123/198 F, DIG. 8, 2; 60/716, 718, 719

[56] References Cited

U.S. PATENT DOCUMENTS

| | | | |
|---|---|---|---|
| 902,692 | 11/1908 | Sherman | 123/198 F |
| 1,306,864 | 6/1919 | Stoddard | 123/DIG. 8 |
| 1,309,279 | 7/1919 | Eggert et al. | 123/198 F |
| 1,900,470 | 3/1933 | Smith | 60/718 |
| 2,623,617 | 12/1952 | Snyder et al. | 123/198 F |
| 2,757,651 | 8/1956 | Winkler | 123/198 F |
| 3,949,556 | 4/1976 | Wallis | 60/718 |
| 4,027,484 | 6/1977 | Wallis | 60/718 |
| 4,027,485 | 6/1977 | Wallis | 60/718 |
| 4,069,803 | 1/1978 | Cataldo | 123/198 F |
| 4,337,623 | 7/1982 | Kronogard | 123/DIG. 8 |

*Primary Examiner*—Ira S. Lazarus

*Attorney, Agent, or Firm*—Martin A. Farber

[57] ABSTRACT

An internal combustion engine comprising a first power unit and a second power unit, in which a clutch of the second power unit is disengaged thereby to disengage the second power unit from an output shaft, when a low reduction gear ratio of a transmission is selected.

7 Claims, 6 Drawing Figures

INTERNAL COMBUSTION ENGINE PROVIDED WITH A PLURALITY OF POWER UNITS

TECHNICAL FIELD

The present invention relates to an internal combustion engine provided with a plurality of power units in which one or more power units are selectively used in accordance with driving conditions of a vehicle driven by the engine.

BACKGROUND ART

It is preferable to design an engine for a constant load so that a desired torque is generated at a low specific fuel consumption. However, it is difficult to design an engine for driving vehicles so as to have a low specific fuel consumption within the entire range of the engine operation, since load on the engine varies in a wide range.

FIG. 1 shows a fuel consumption characteristic of an engine for a vehicle at various specific fuel consumptions (g/ps.hr), in which the abscissa is engine speed (r.p.m.), and the ordinate is engine torque. Curve A shows running load (resistance) of a vehicle on a flat road. The curve A is determined by the air resistance of the body of the vehicle and the gear ratio of the transmission of the engine and the specific fuel consumption is determined by the performance of the engine. As seen from FIG. 1, the engine of FIG. 1 is so designed as to have lower fuel consumption at a higher engine torque range than that of a lower engine torque range and so that the curve A may pass through low fuel consumption zones in the higher engine torque range. However, the engine designed to have a low fuel consumption in a higher engine torque range has poor fuel consumption in a lower torque range.

SUMMARY OF THE INVENTION

The object of the present invention is to provide an engine for a vehicle, which is provided with a plurality of power units, one or more power units of which are selectively operated in accordance with conditions of the engine operation, whereby the engine is operated in low fuel consumption zones within a wide range of the engine operation.

The engine of the present invention comprises at least two power units, one of which is a first power unit and the other is a second unit. In a high torque range, all power units are operated, and in a low torque range, the first power unit is operated to drive the vehicle.

The engine of the present invention is designed to have a fuel consumption characteristic shown in FIG. 1 by operating all power units, and the first power unit is designed to have a fuel consumption characteristic shown in FIG. 2. The running load curve B is arranged to pass through the lowermost fuel consumption zone D in fuel consumption zone C.

The engine of the present invention is provided with means for detecting a low reduction gear ratio selection of a transmission, means for detecting a light load operation of the engine, and a control circuit responsive to output signals from both detecting means for disengaging the second power unit.

BEST MODE FOR EMBODYING THE INVENTION

Figure 1:
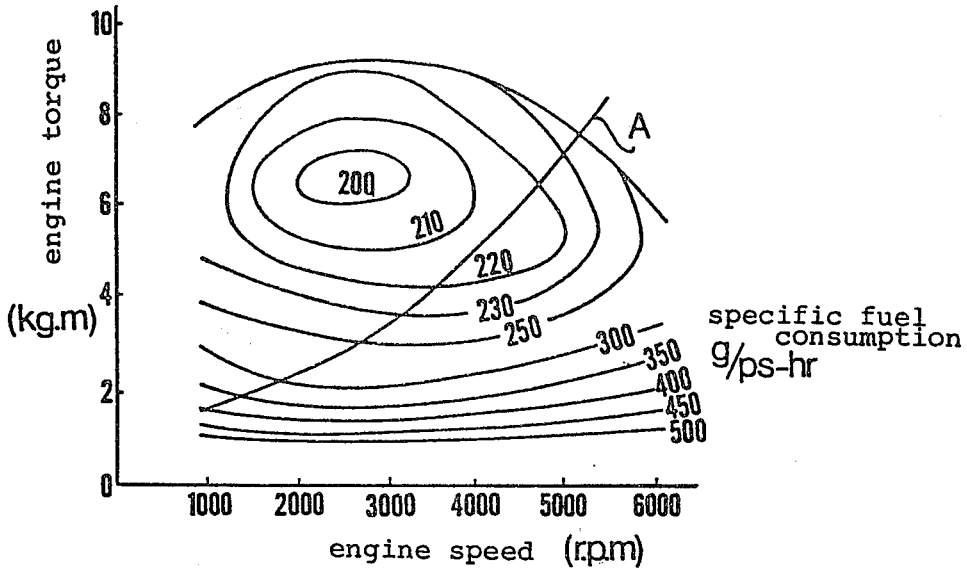
FIG. 1 is a graph showing a fuel consumption characteristic of an engine according to the present invention when all power units operate.

The present invention will be explained in detail hereinafter with reference to FIGS. 3 to 6. The illustrated engine according to the present invention comprises a first power unit 1 of a two-cylinder type, and a second power unit 2 of two-cylinder type.

Pistons 4 and 5 of the first power unit 1 are connected to a crankshaft 3 by connecting rods respectively. On the other hand, pistons 7 and 8 of the second power unit 2 are connected to a crankshaft 6 by respective connecting rods. A power transmitting gear 9 securely mounted on the crankshaft 3 engages with an output gear 11 mounted on an output shaft 10. The crankshaft 6 is connected to a transmitting shaft 13 through an electromagnetic powder clutch 12. A transmitting gear 14 on the shaft 13 engages with the output gear 11. A flywheel 15 provided with a clutch is mounted on the output shaft 10, and an output shaft 17 of the clutch is connected to a transmission 16.

Figure 6:
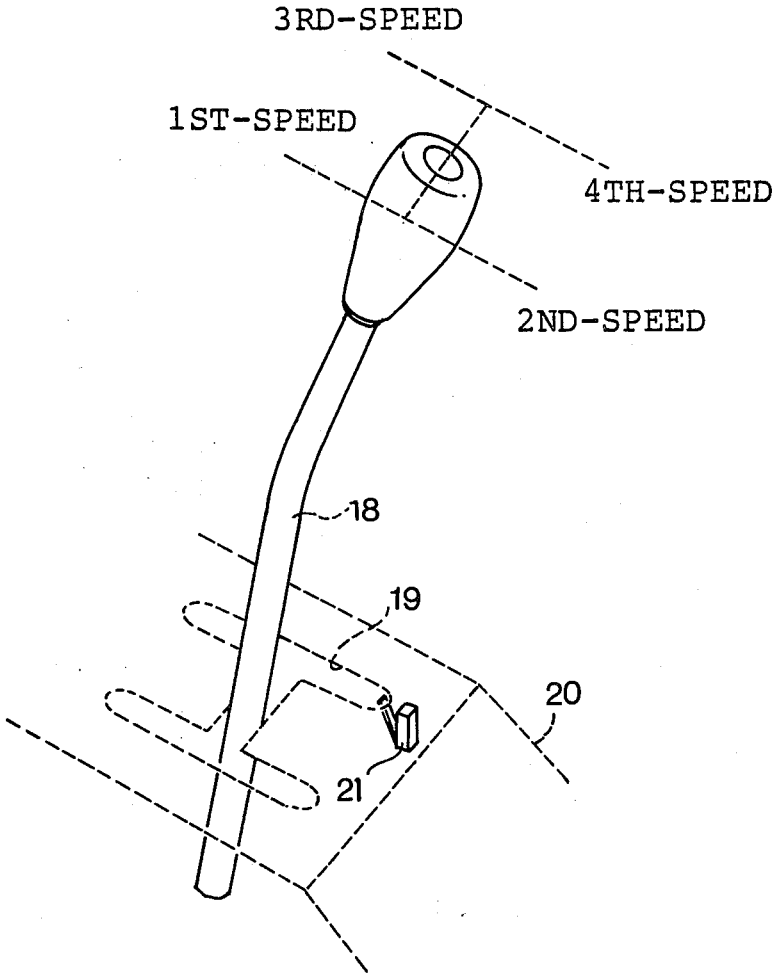
FIG. 6 is a perspective view showing a gear shift lever portion.

The transmission 16 is provided with change gears of first-speed gear to fourth-speed gear. As shown in FIG. 6, a gear shift lever 18 for the transmission is shifted along an H-shaped guide slit 19. In a console box 20 provided with the guide slit 19, a 4th-speed switch 21 is provided such that the 4th-speed switch 21 is closed when the gear shift lever 18 is shifted to the 4th-speed position. The signal of the 4th-switch upon the closing thereof is fed to a low reduction gear ratio detecting circuit 22. The detecting circuit 22 produces an output signal when the switch 21 is closed. The output signal of the circuit 22 is applied to a control circuit 23 causing it to send a signal to the clutch 12 for disengagement thereof.

Figure 4:
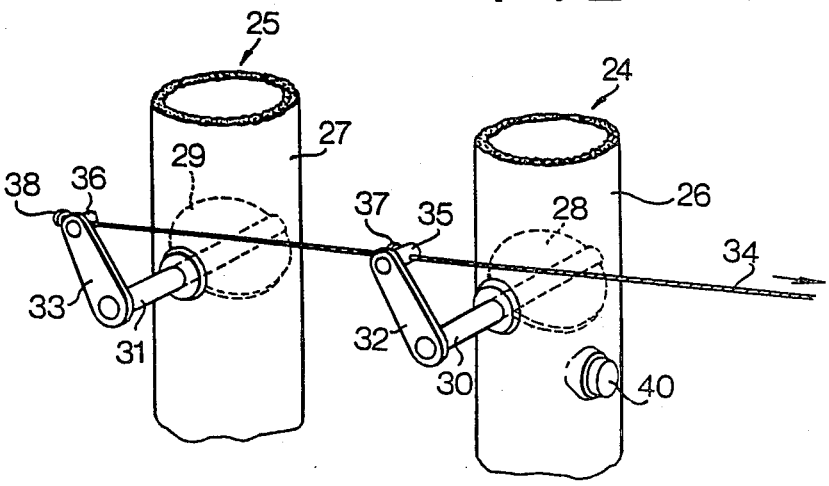
FIG. 4 is a schematic perspective view of a carburetor assembly of the engine.
Figure 5:
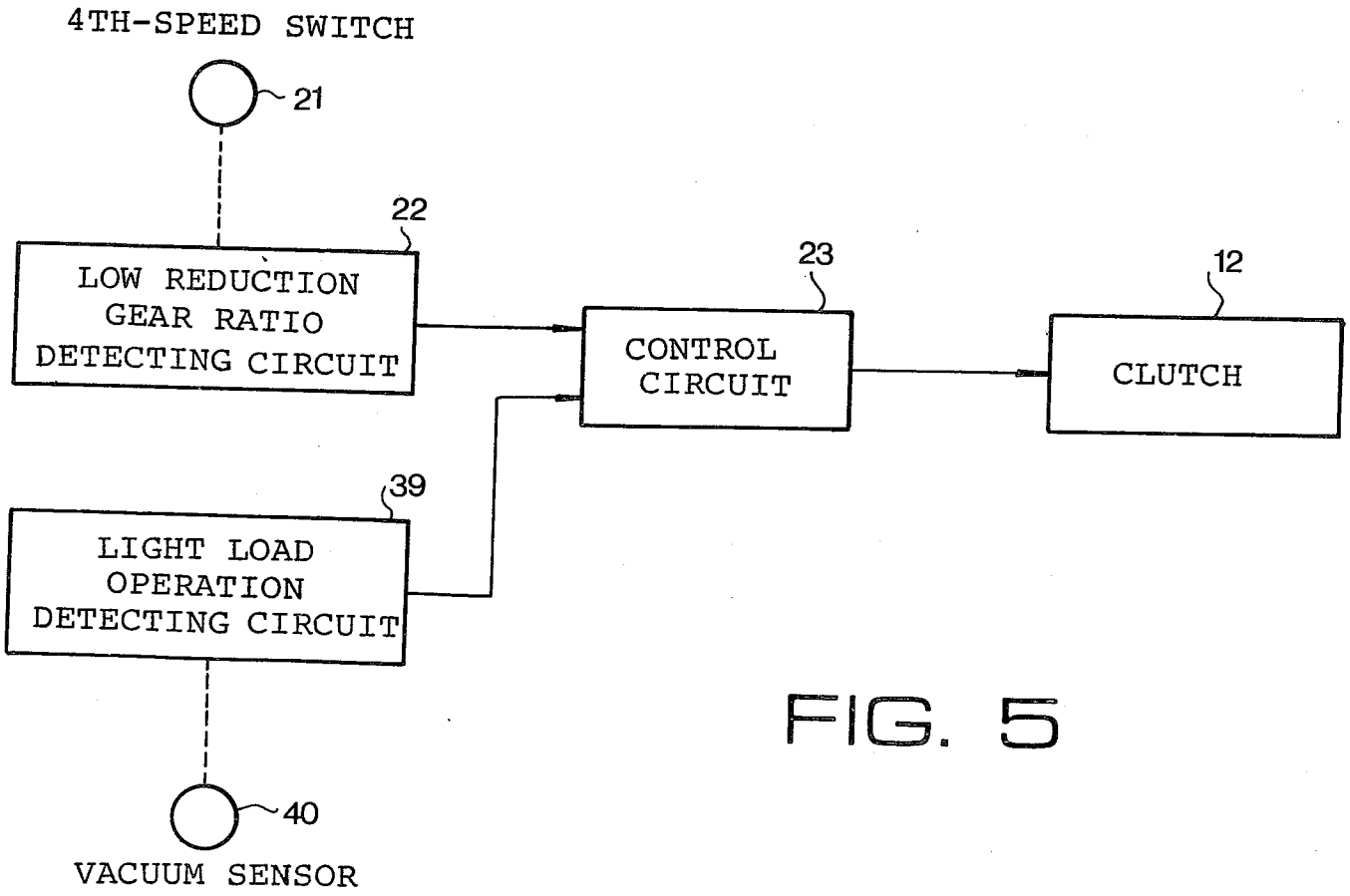
FIG. 5 is a block diagram showing a control system of the present invention.

Referring to FIG. 4, carburetors 24 and 25 for power units 1 and 2 comprise parallel barrels 26 and 27, with throttle valves 28 and 29 supported by throttle shafts 30 and 31, respectively. Levers 32 and 33 are secured to the throttle shafts 30 and 31, the levers 32 and 33 having pins 35 and 36 each having a hole. An accelerator wire 34 passes through the holes in the pins. Stops 37 and 38 are fixed to the accelerator wire 34 as to engage with the pins 35 and 36 when the accelerator wire 34 is pulled in the direction of an arrow shown in FIG. 4.

A vacuum sensor 40 is provided in the barrel 26 of the main carburetor 24 for detecting the vacuum in the induction passage downstream of the throttle valve 28. The vacuum sensor 40 sends a signal to a light load operation detecting circuit 39 (FIG. 5) for detecting a light load operation of the engine when the vacuum exceeds a predetermined value. The light load operation detecting circuit 39 sends an output signal to the control circuit 23 in dependency on the signal from the vacuum sensor 40. The control circuit 23 is provided with an AND circuit which produces an output signal in response to both signals from the circuits 22 and 39. The output signal is fed to the clutch 12 for disengagement thereof and also is fed to an ignition device (not shown) of the second power unit 2.

In operation, when a starter (not shown) is operated, the flywheel 15 is driven. At that time, since no signal is fed from the 4th-switch 21 to the detecting circuit 22, the control circuit 23 sends a signal to the clutch 12, so that the clutch 12 is engaged. Accordingly, both units 1 and 2 are started. As long as the vehicle is driven by the 1st-speed gear to the 3rd-speed gear, the clutch 12 is engaged. Therefore, both power units operate to drive the vehicle. In such a driving condition with the 1st to 3rd-speed gears, relatively higher engine torque is required, to drive the vehicle, for example, to start and to accelerate the vehicle.

Figure 2:
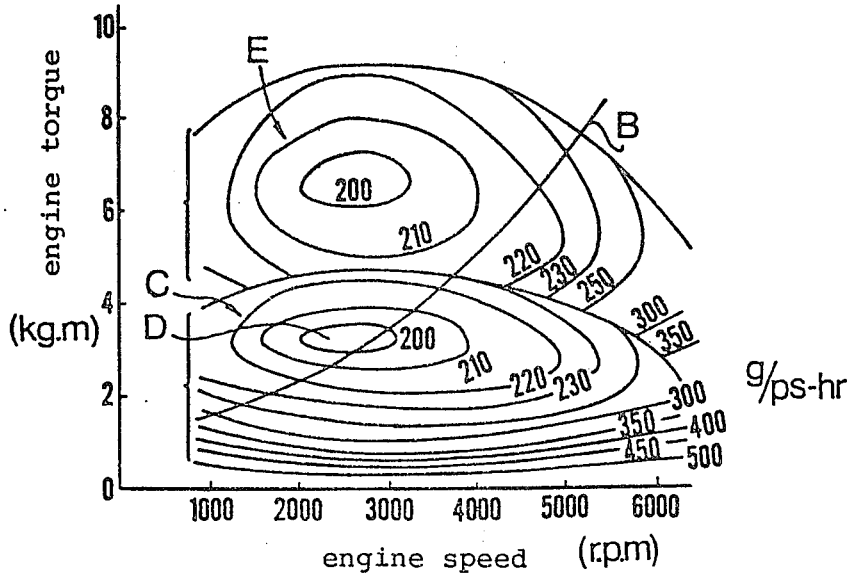
FIG. 2 is a graph showing a fuel consumption characteristic of the engine of the present invention when a first power unit operates.
Figure 3:
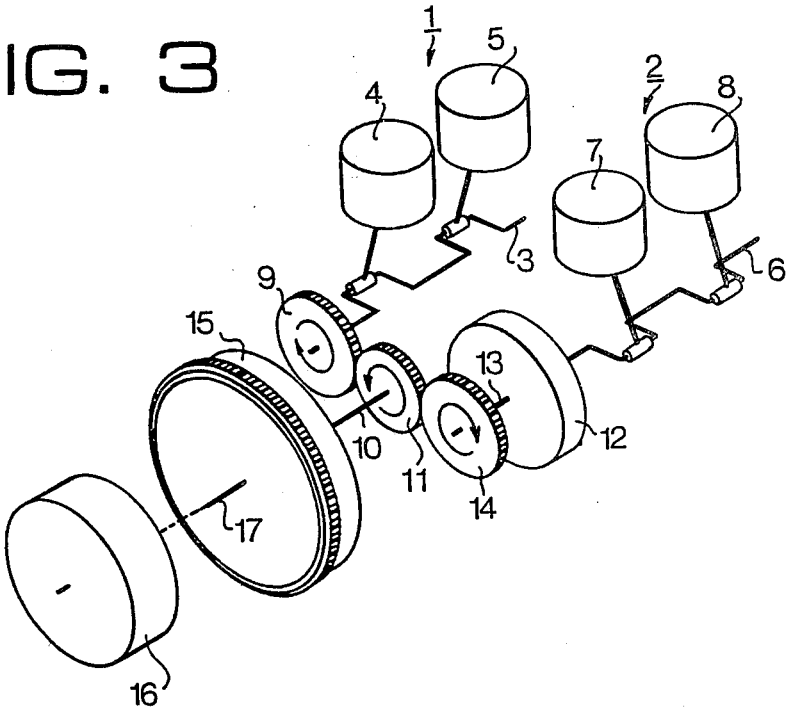
FIG. 3 is a schematic perspective view of an engine according to the present invention.

When the gear shift lever 18 is shifted to the 4th-speed position and the 4th-speed gear of the transmission 16 is selected, the 4th-switch 21 is closed, so that the low reduction gear ratio detecting circuit 22 sends a signal to the control circuit 23. When the vehicle speed reaches a high speed and the engine is operated in a steady state by a slight depression of the vehicle accelerator pedal (not shown), the opening degree of the throttle valve 28 decreases so that the vacuum pressure in the induction passage increases. When the vacuum pressure reaches a predetermined value, the vacuum sensor 40 operates and the light load operation detecting circuit 39 sends a signal to the control circuit 23. Thus, the control circuit 23 produces a signal which is applied to the clutch 12 to disengage it. Accordingly, the second power unit 2 is disengaged from the transmitting shaft 13 and the operation of the unit 2 is stopped. Therefore, the vehicle is driven by only the first power unit 1. The fuel consumption characteristic of the first power unit is shown by C in FIG. 2 and the running load curve B passes through the lowermost fuel consumption zone D. Thus, the vehicle can be driven at a low fuel consumption.

Under such a steady condition, if the opening degree of the throttle valve decreases for deceleration or increases for acceleration or the gear shift lever 18 is shifted to a position other than the 4th-speed position, the control circuit 23 produces a signal to engage the clutch 12. Thus, the second power unit 2 is connected to the output shaft 10 and started, so that the vehicle is driven by both power units 1 and 2 at a high engine torque.

The engine according to the present invention comprises at least two independent power units, at least one of the power units being connected to an output shaft and the other power unit being connected to the output shaft through a clutch, and further comprises gear selection detecting means for detecting the selection of a low reduction gear ratio, which operates to produce a signal when the gear shift lever is shifted to the low gear ratio position. A light load detecting means produces a signal when the engine is operated at a light load, and a control circuit responsive to signals from both the detecting means disengages the clutch for driving the vehicle by one power unit. Thus, the vehicle is driven by the engine at a low fuel consumption in a steady state of the engine.

I claim:

1. An internal combustion engine for a vehicle, which comprises a plurality of independent power units which are selectively used in accordance with driving conditions of the vehicle, an output shaft, a transmission operatively connected with the output shaft, said transmission having a plurality of selectively shiftable reduction gear ratios, at least one of said power units is operatively connected to the output shaft, clutch means for operatively connecting another of said power units to the output shaft, gear ratio detecting means for producing a first output signal when a low reduction gear ratio of the transmission is selected, engine load detecting means for producing a second output signal when the engine is operated at a light load, that a control circuit is provided to respond to both output signals from both the detecting means for producing an output signal which is applied to the clutch for disengaging it.

2. An internal combustion engine for a vehicle having induction passages and throttle valves comprising a first engine unit comprising a plurality of first cylinder units and a first crankshaft operatively connected to said cylinder units, a secondary engine unit comprising a plurality of second cylinder units and a second crankshaft operatively connected to said second cylinder units, a first clutch operated to one end of said second crankshaft of the secondary engine unit, said clutch has an output shaft, a main output shaft operatively connected to one end of said first crankshaft of the first engine unit and to the output shaft of said clutch, a second clutch, a transmission having an operatively selectable plurality of speed gears, said transmission being operatively connected to said main output shaft via said second clutch, first means for detecting shift selection of a high speed gear in said transmission and for producing a first output signal thereupon, second means for detecting a light load condition on the engine and for producing a second output signal thereupon, and a control circuit responsive to said first and second output signals for producing a third output signal for disengaging said first clutch.

3. The internal combustion engine according to claim 2, wherein said first clutch is an electromagnetic clutch.

4. The internal combustion engine according to claim 2, further comprising a gear shift lever operatively connected to said speed gears, said first means for detecting the shift selection of a high speed gear comprises a switch positioned so as to be actuated operated by said gear shift lever when the latter is in a position corresponding to said high speed gear.

5. The internal combustion engine according to claim 2, wherein said first engine unit includes an induction passage and a throttle valve therein, said second means for detecting a light load is a vacuum sensor operated by vacuum in the induction passage of the first engine unit downstream of said throttle valve.

6. The internal combustion engine according to claim 2, wherein said second clutch comprises a flywheel and a clutch means for respectively engaging and disengaging said main output shaft with said transmission.

7. The internal combustion engine according to claim 2, wherein said control circuit comprises an AND gate.

* * * * *